US010436419B2

(12) United States Patent
Lee et al.

(10) Patent No.: US 10,436,419 B2
(45) Date of Patent: Oct. 8, 2019

(54) VARIABLE FOCUS SPOT LIGHT WITH SPIN TYPE FOCUSING STRUCTURE

(71) Applicant: JRF Photonics Tech. Co., Ltd., Tianjin (CN)

(72) Inventors: Xuan-Hao Lee, Taoyuan (TW); Yeh-Wei Yu, Taoyuan (TW); Chiu-Fen Wang, Taoyuan (TW)

(73) Assignee: CentraLED Technology Co., Ltd., Taoyuan (TW)

( * ) Notice: Subject to any disclaimer, the term of this patent is extended or adjusted under 35 U.S.C. 154(b) by 0 days.

(21) Appl. No.: 15/411,139

(22) Filed: Jan. 20, 2017

(65) Prior Publication Data

US 2018/0209612 A1 Jul. 26, 2018

(51) Int. Cl.

| | |
|---|---|
| ***F21V 14/06*** | (2006.01) |
| ***F21V 7/04*** | (2006.01) |
| ***F21V 5/04*** | (2006.01) |
| ***F21V 17/02*** | (2006.01) |
| ***F21V 13/04*** | (2006.01) |
| *F21Y 115/00* | (2016.01) |

(52) U.S. Cl.

CPC ..... *F21V 14/06* (2013.01); *F21V 5/04* (2013.01); *F21V 7/04* (2013.01); *F21V 13/04* (2013.01); *F21V 17/02* (2013.01); *F21Y 2115/00* (2016.08)

(58) Field of Classification Search

CPC ..... F21V 14/06; F21V 17/02

See application file for complete search history.

(56) References Cited

U.S. PATENT DOCUMENTS

| | | | | |
|---|---|---|---|---|
| 4,870,548 | A * | 9/1989 | Beachy | F21S 8/081 362/145 |
| 6,721,111 | B2 * | 4/2004 | Nomura | G02B 7/021 353/100 |
| 2005/0078482 | A1 * | 4/2005 | Bartlett | F21V 19/02 362/285 |
| 2009/0091925 | A1 * | 4/2009 | Hesse | F21L 4/04 362/187 |
| 2013/0301254 | A1 * | 11/2013 | Popper | F21L 4/04 362/188 |
| 2014/0049967 | A1 * | 2/2014 | Zhou | F21V 14/06 362/287 |

* cited by examiner

*Primary Examiner* — Jong-Suk (James) Lee
*Assistant Examiner* — Christopher E Dunay
(74) *Attorney, Agent, or Firm* — Juan Carlos A. Marquez; Marquez IP Law Office, PLLC

(57) ABSTRACT

The present invention discloses variable focus spotlight with spin type focusing structure, the variable focus spotlight includes a shell, a driving ring and a focusing module. With the implementation of the present invention, the focusing module slides toward or away from the light source in the shell by rotating a driving ring which pulls the connecting rods penetrating position spiral slits on the shell, so that the variable focus spotlight with spin type focusing structure can easily output a broad beam, a collimated beam, or a beam ranging between the broad beam and the collimated beam according to user's needs to widely promote applications of the variable focus spotlight.

5 Claims, 12 Drawing Sheets

VARIABLE FOCUS SPOT LIGHT WITH SPIN TYPE FOCUSING STRUCTURE

BACKGROUND OF THE INVENTION

1. Technical Field

The present invention relates to spotlights, and more particularly to variable focus spotlights with spin type focusing structure.

2. Description of Related Art

With rapid development of diversity of light sources and illumination efficiency being constantly increasing with the modernization of society. There are more and more market demands for spotlights for interior illumination, special illumination, rescue and searching, platform illumination, photographic illumination or even vehicle illumination.

However, the market is still in want of a spotlight which can directly output a broad beam, a collimated beam, or a beam ranging between the broad beam and the collimated beam, let alone a spotlight capable of changing its focus whenever needed.

On the other hand, most of the conventional spotlights require a complicated manufacturing process in mass production, and the finished spotlights are simply incapable of outputting an approximately collimated beam, meaning stray light will be generated during operation and thus compromise efficiency of use.

It is therefore highly desirable in the spotlight application-related industries to have a useful, low-cost yet high-quality, compact variable focus spotlight with spin type focusing structure which can be easily manufactured from simple optical and mechanical components without using expensive equipment, and which can output a broad and uniform beam in a broad beam mode and an approximately collimated beam without stray light in a collimated beam mode.

BRIEF SUMMARY OF THE INVENTION

The present invention discloses variable focus spotlight with spin type focusing structure, the variable focus spotlight includes a shell, a driving ring and a focusing module. With the implementation of the present invention, the focusing module slides toward or away from the light source in the shell by rotating a driving ring which pulls the connecting rods penetrating position spiral slits on the shell, so that the variable focus spotlight with spin type focusing structure can easily output a broad beam, a collimated beam, or a beam ranging between the broad beam and the collimated beam according to user's needs to widely promote applications of the variable focus spotlight.

The present invention provides a variable focus spotlight with spin type focusing structure, comprising: a shell having a light exit opening, at least two spiral slits and a light source holder, wherein the light exit opening is disposed at one end of the shell, the spiral slits are spiral slots penetrating through the shell, respectively, and at least one light source is fixedly provided on the light source holder and disposed at the other end opposite to the light exit opening; a driving ring, fixedly provided surrounding a part of the shell; and a focusing module, coaxially provided beside the light source holder inside the shell, wherein the focusing module includes a lens fixed on a lens holder and being illuminated by the light source, wherein at least two linking rods, each one penetrates through one of the at least two spiral slits, is connected with the lens holder and the driving ring.

The present invention further provides another variable focus spotlight with spin type focusing structure, comprising: a shell having a light exit opening, at least two spiral slits and a lens, wherein the light exit opening is disposed at one end of the shell, the spiral slits are spiral slots penetrating through the shell, respectively, and the lens is fixedly provided inside the shell and beside the light exit opening; a driving ring, fixedly provided surrounding a part of the shell; and a focusing module, coaxially provided beside the lens inside the shell, wherein the focusing module includes a light source fixed on a light source holder, wherein at least two linking rods, each one penetrates through one of the at least two spiral slits and connects with the light source holder and the driving ring.

Implementation of the present invention at least provides the following advantageous effects:

1. Structural simplicity, ease of manufacturing, and low costs.
2. Ease of implementation and use to promote and increase the scope of applications.
3. Capable of outputting a broad beam, a collimated beam, or a beam ranging between the broad beam and the collimated beam.

The features and advantages of the present invention are detailed hereinafter with reference to the preferred embodiments. The detailed description is intended to enable a person skilled in the art to gain insight into the technical contents disclosed herein and implement the present invention accordingly. In particular, a person skilled in the art can easily understand the objects and advantages of the present invention by referring to the disclosure of the specification, the claims, and the accompanying drawings.

BRIEF DESCRIPTION OF THE SEVERAL VIEWS OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
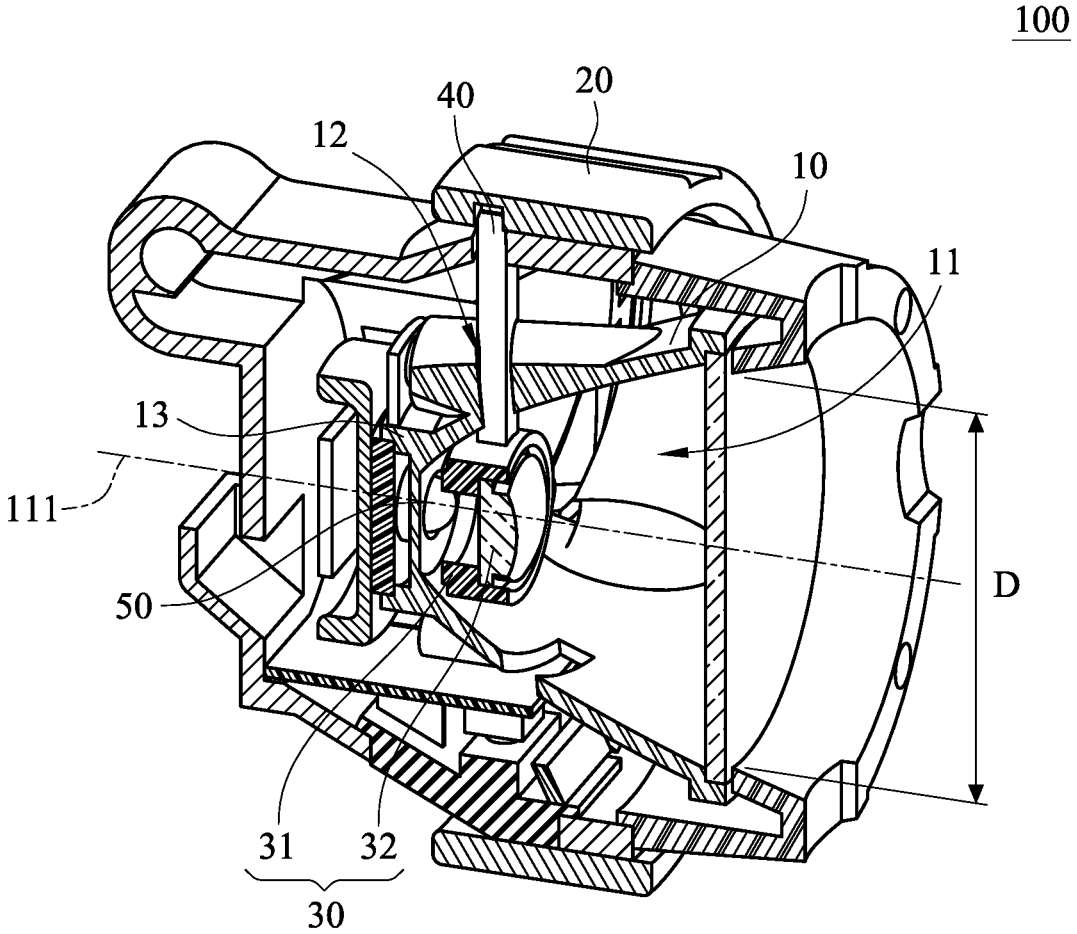
FIG. 1 is a schematic sectional view of the variable focus spotlight with spin type focusing structure in an embodiment of the present invention.

Please refer to FIG. 1, the variable focus spotlight with spin type focusing structure 100 in an embodiment of the present invention includes a shell 10, a driving ring 20, and a focusing module 30.

The aforesaid variable focus spotlight with spin type focusing structure 100 can be a regular light bulb variable focus spotlight, a LED variable focus spotlight, a LD variable focus spotlight or an OLED variable focus spotlight. At the same time, the type, composing material or shape of it can be widely chosen as required without any specific limitation.

As shown in FIG. 1, shell 10 having a light exit opening 11, at least two spiral slits 12 and a light source holder 13, wherein the light exit opening 11 is at one end of the shell 10, the spiral slits 12 are spiral slots penetrates through the shell body of the shell 10, and at least one light source 50 is fixedly provided on the light source holder 13 at the other end opposite to the light exit opening 11.

When in an embodiment, the light source 50 and the light source holder 13 is being fixed on a position in the central axis 111 of the light exit opening 11 such that the shell 10 can evenly reflect the light illuminated by the light source 50 and reaching the interior surface of the shell 10, and at the same time, making the lens 32 on the focusing module 30 conducting better focusing or broadening effect of the light source 50.

Figure 2:
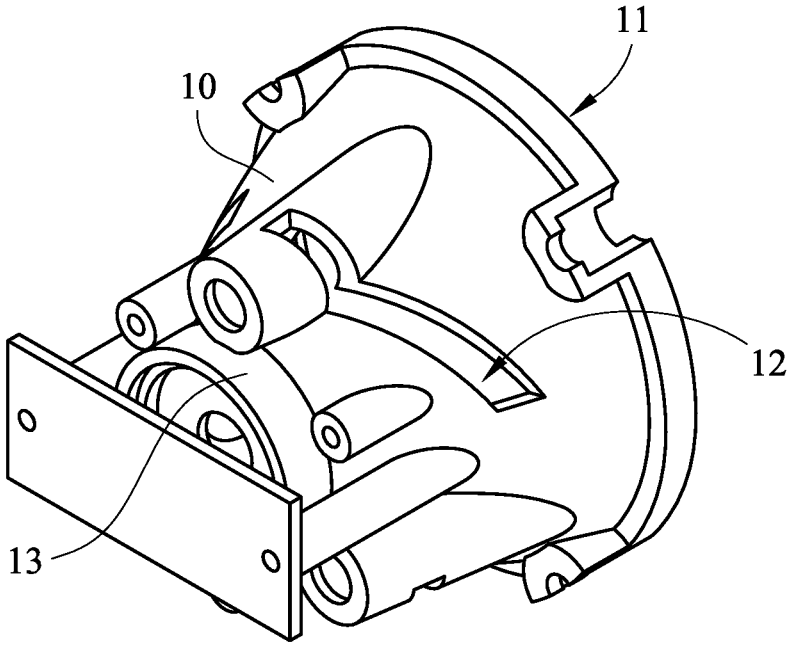
FIG. 2 is a schematic view of a shell in an embodiment of the present invention.

Referring to FIG. 1 and FIG. 2, the spiral slits 12 are formed on the shell body of the shell 10 with the number of the spiral slits 12 being two, three or more. When the linking rods 40 are driven by the driving ring 20, the linking rods 40 are moved in the forward and backward directions according to the shape of the spiral slits 12 because they are limited to the spiral slits 12.

The shell 10 can be a reflector of light or a reflector combined with a cup shape structure, which reflects the reaching light illuminated by the light source 50 to the light exit opening 11 and to emit out from the shell 10.

Figure 4:
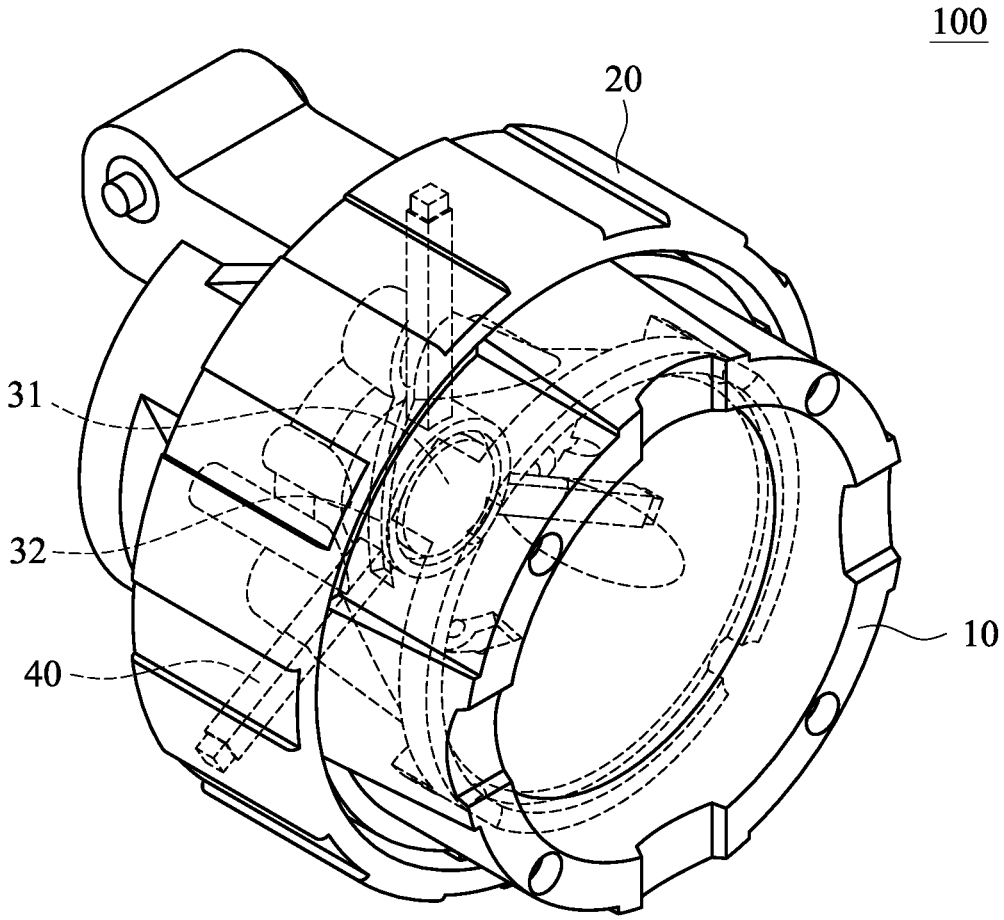
FIG. 4 is a schematic three dimensional view of the variable focus spotlight with spin type focusing structure in an embodiment of the present invention.

As shown in FIG. 1 and FIG. 4, the driving ring 20, being fixedly provided surrounding a part of the shell 10, and can be rotated clockwise or counter clockwise when looking to the variable focus spotlight with spin type focusing structure 100 from the light exit opening 11.

Figure 3:
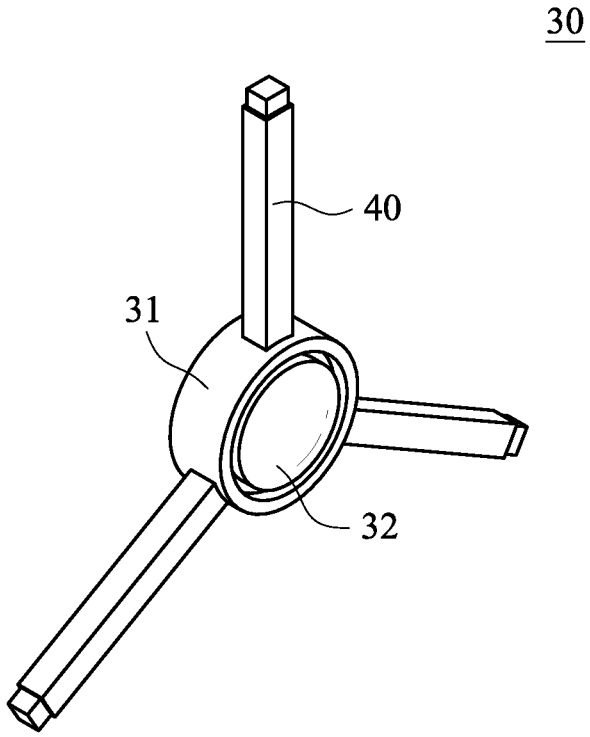
FIG. 3 is a schematic view of a focusing module in an embodiment of the present invention.

As shown in FIG. 1 and FIG. 3, the focusing module 30 is being coaxially provided beside the light source holder 13 inside the shell 10, wherein the focusing module 30 includes a lens 32 being fixed on a lens holder 31 and being illuminated by the light source 50, wherein at least two linking rods 40, each penetrates through one spiral slit 12, being connecting the lens holder 31 and the driving ring 20.

As such, the linking rods 40 slide in the spiral slits 12 when rotating the driving ring 20 clockwise or counter clockwise and drive the whole focusing module 30 moving toward or away from the light source 50.

Figure 5:
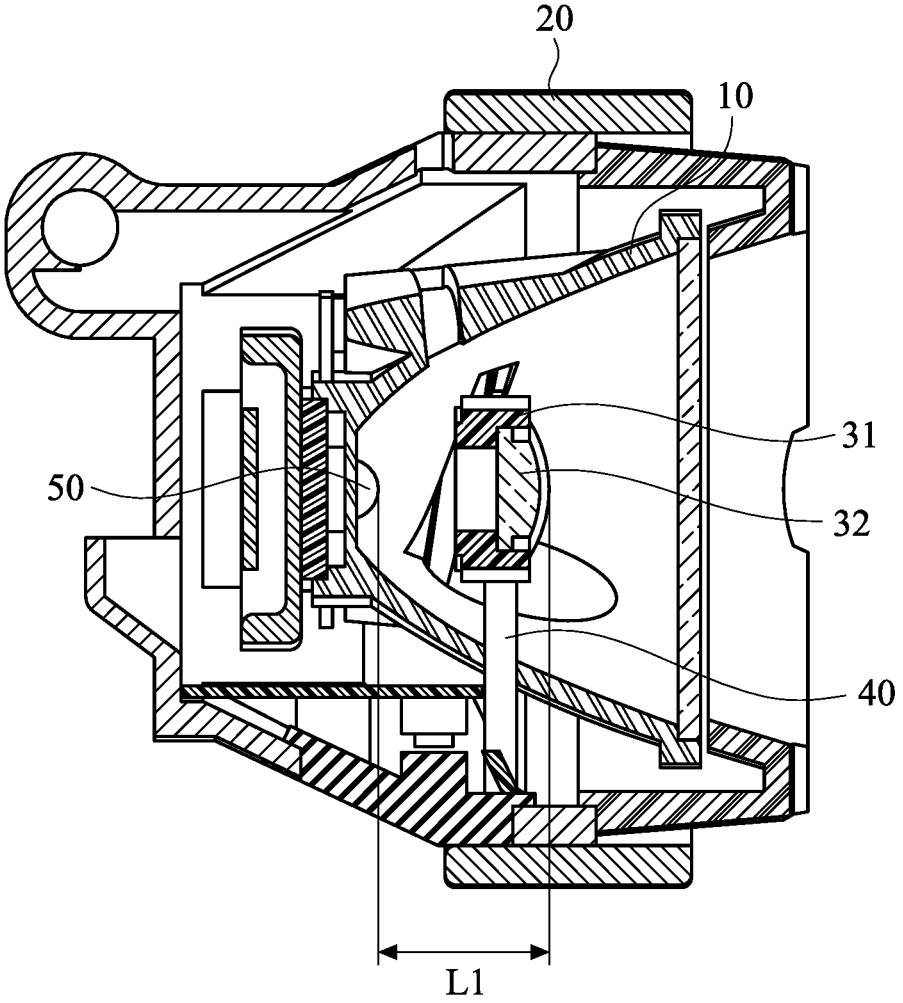
FIG. 5 is a schematic sectional view of the variable focus spotlight with spin type focusing structure generating collimated beam in an embodiment of the present invention.

As shown in FIG. 5, as the distance L1 between the focusing module 30 and the light source 50 is getting closer to the focal length of the lens 32, the light or light beam illuminated from the light source 50 is getting more condensed by the focusing module 30. And when the distance L1 between the focusing module 30 and the light source 50 reaches the focal length of the lens 32, the light or light beam illuminated from the light source 50 becomes a collimated beam after passing through the focusing module 30.

Figure 6:
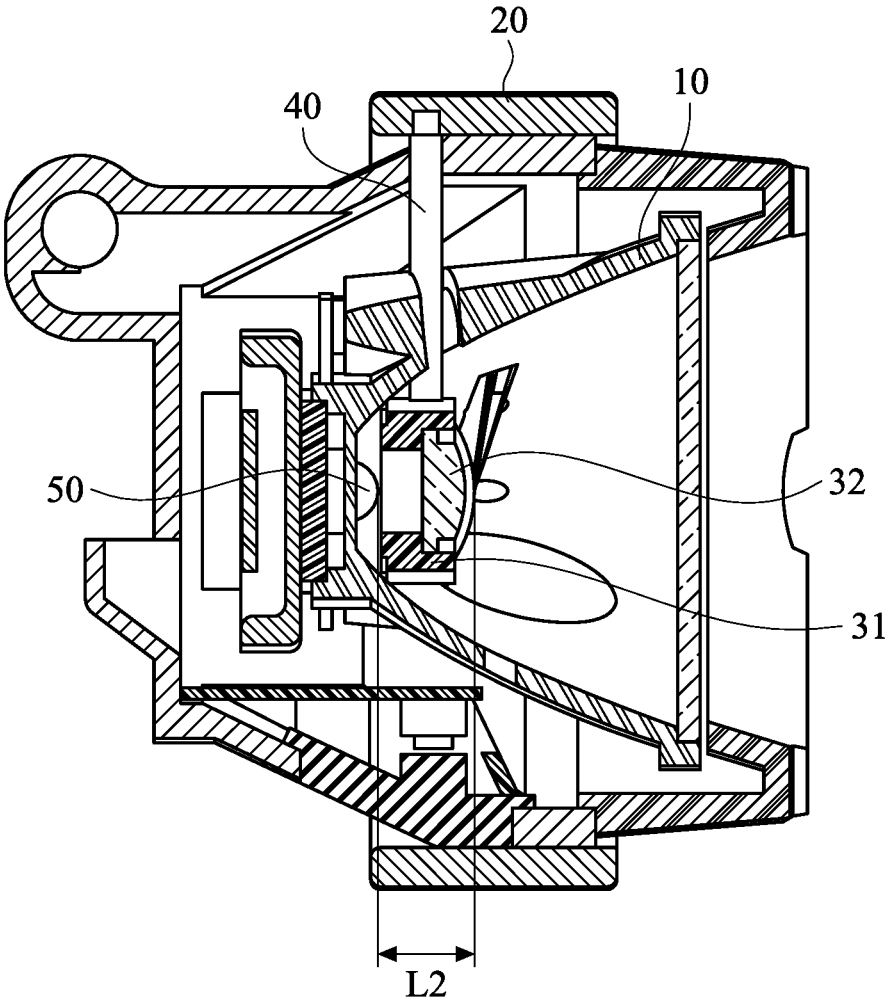
FIG. 6 is a schematic sectional view of the variable focus spotlight with spin type focusing structure generating broad beam in an embodiment of the present invention.

While as shown in FIG. 6, as the distance L2 between the focusing module 30 and the light source 50 is getting further away from the focal length of the lens 32, the light or light beam illuminated from the light source 50 is getting more broadened by the focusing module 30.

As shown in FIG. 1, the position of the lens 32 can be settled to possess a same axis with the light exit opening 11.

All in all, as shown in the embodiments, rotating the driving ring 20 changes the relative position of the light source 50 and the lens 32, and thus enabling the variable focus spotlight with spin type focusing structure 100 to output collimated light beam or broad light beam or light beam shape in between collimated beam and broad beam.

Figure 7:
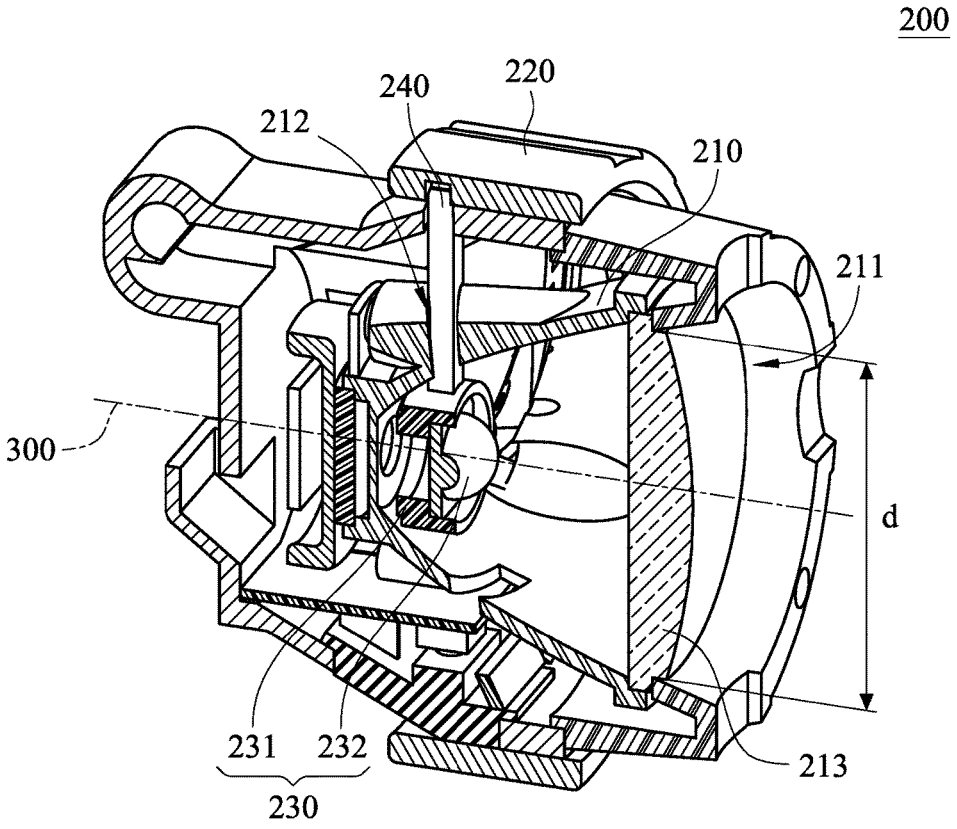
FIG. 7 is a schematic sectional view of another variable focus spotlight with spin type focusing structure in an embodiment of the present invention.

Please refer further to FIG. 7, the variable focus spotlight with spin type focusing structure 200 in another embodiment of the present invention includes a shell 210, a driving ring 220, and a focusing module 230.

Variable focus spotlight with spin type focusing structure 200 can be a regular light bulb variable focus spotlight, a LED variable focus spotlight, a LD variable focus spotlight or an OLED variable focus spotlight. At the same time, the type, composing material or shape of it can be widely chosen as required without any specific limitation.

As shown in FIG. 7, the shell 210 has a light exit opening 211, at least two spiral slits 212 and a light source holder 213, wherein the light exit opening 211 is at one end of the shell 210, the spiral slits 212 are spiral slots penetrating through the shell body of the shell 210, and a lens 213 is fixedly provided inside the shell 210 beside the light exit opening 11.

Figure 8:
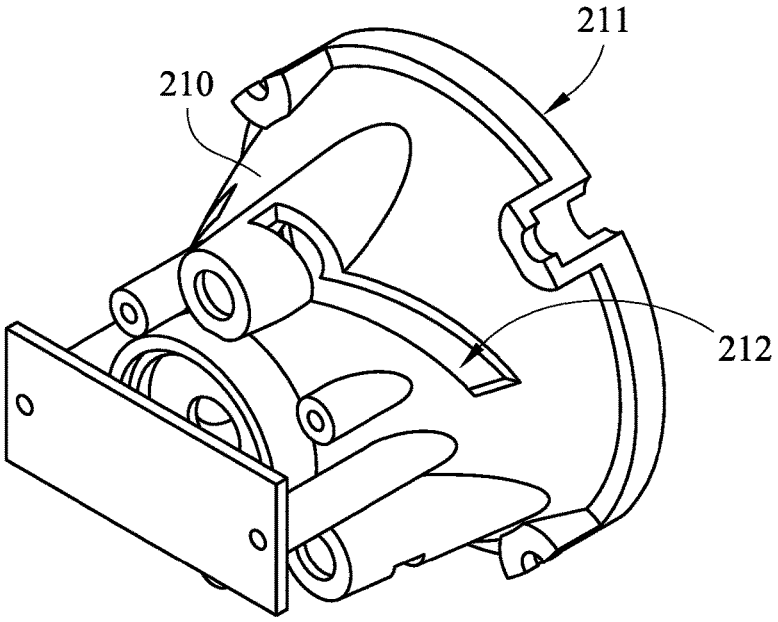
FIG. 8 is a schematic view of another shell in an embodiment of the present invention.

Referring to FIG. 7 and FIG. 8, the spiral slits 212 are formed on the shell body of the shell 210 with the number of the spiral slits 212 being two, three or more.

The shell 210 can be a reflector of light or a reflector combined with a cup shape structure, which reflects the reaching light illuminated by the light source 232 to the light exit opening 211 and to emit out from the shell 210.

Figure 10:
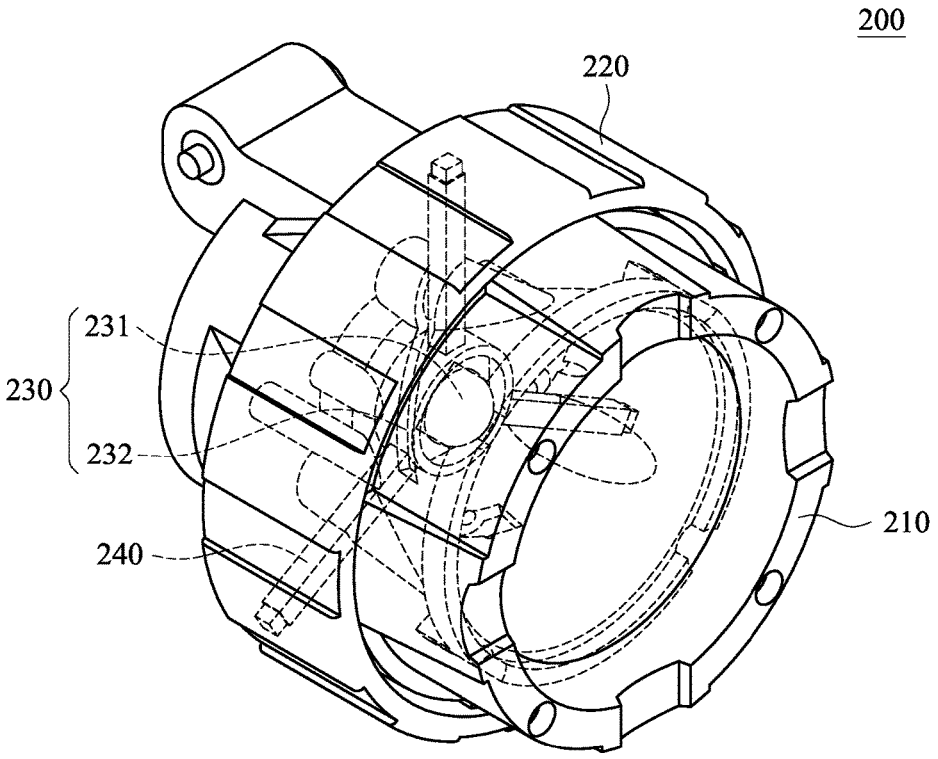
FIG. 10 is a schematic three dimensional view of the variable focus spotlight with spin type focusing structure in another embodiment of the present invention.

As shown in FIG. 7 and FIG. 10, the driving ring 220, being fixedly provided surrounding a part of the shell 210, and can be rotated clockwise or counter clockwise when looking to the variable focus spotlight with spin type focusing structure 200 from the light exit opening 211.

Figure 9:
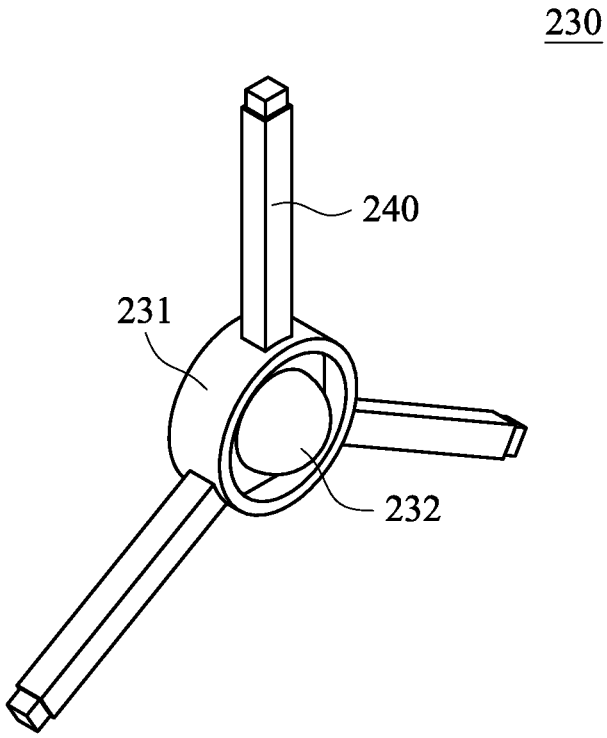
FIG. 9 is a schematic view of another focusing module in an embodiment of the present invention.

As shown in FIG. 7 and FIG. 9, the focusing module 230 includes a light source 232 being fixed on a light source holder 231, the light emit by the light source 232 illuminates the lens 213 and being modulated by the lens 213.

Further, at least two linking rods 240, each penetrates through one spiral slit 212, being connecting the light source holder 231 and the driving ring 220.

As such, the linking rods 240 slide in the spiral slits 212 when rotating the driving ring 220 clockwise or counter clockwise and drive the whole focusing module 230 inside the shell 210 moving toward or away from the lens 213.

Figure 12:
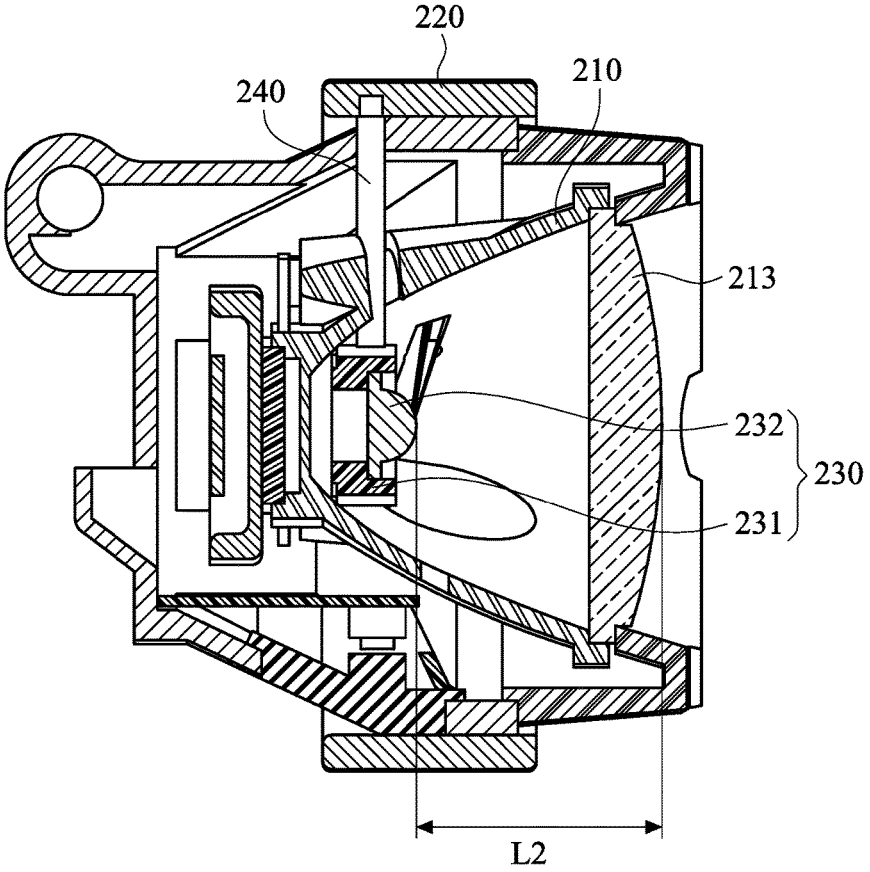
FIG. 12 is a schematic sectional view of the variable focus spotlight with spin type focusing structure generating broad beam in another embodiment of the present invention.

As shown in FIG. 12, as the focusing module 230 getting closer to the focal point of the lens 213 inside the shell 210, the light or light beam illuminated from variable focus spotlight with spin type focusing structure 200 is getting more condensed. And when he focusing module 230 reaches the focal point of the lens 32, the light or light beam illuminated from the variable focus spotlight with spin type focusing structure 200 becomes a collimated beam.

Figure 11:
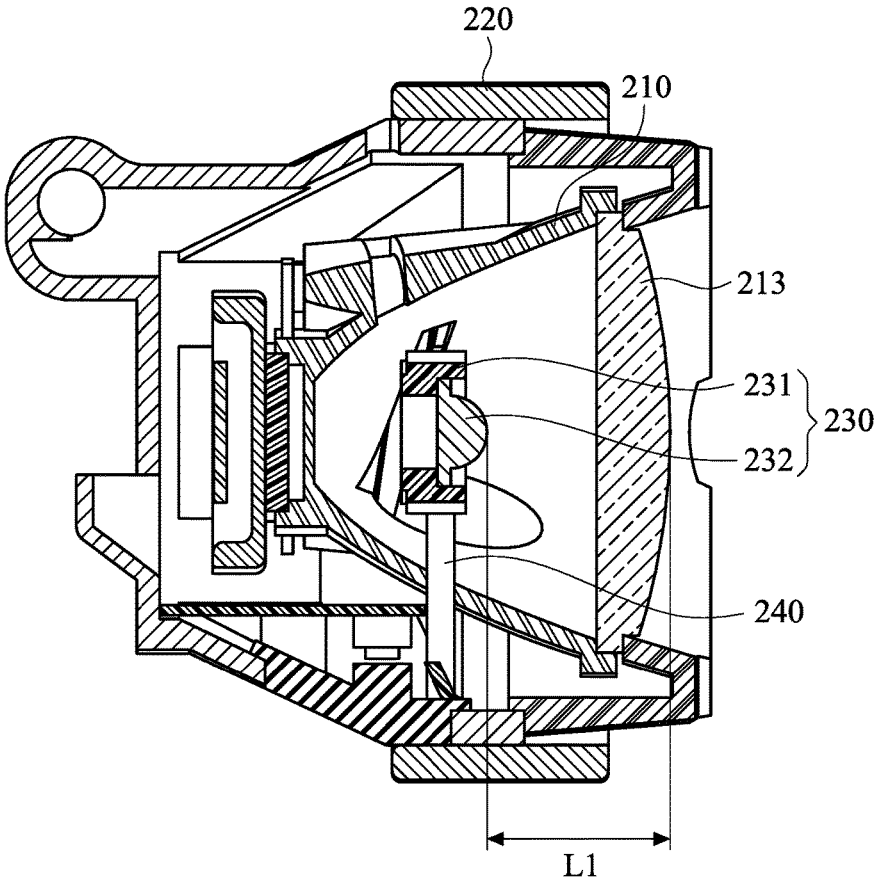
FIG. 11 is a schematic sectional view of the variable focus spotlight with spin type focusing structure generating collimated beam in another embodiment of the present invention.

While as shown in FIG. 11, as the focusing module 230 is getting further away from the focal point of the lens 213, the light or light beam illuminated from the variable focus spotlight with spin type focusing structure 200 is getting more broadened.

As shown in FIG. 7, the position of the light source 232 can be settled to possess a same axis 300 with the light exit opening 211.

As in the embodiments, rotating the driving ring 220 changes the relative position of the light source 232 and the lens 213, and thus enabling the variable focus spotlight with spin type focusing structure 200 to output collimated light beam or broad light beam or light beam shape in between collimated beam and broad beam.

As such, the variable focus spotlight with spin type focusing structure 100 or the variable focus spotlight with spin type focusing structure 200 has the benefit of structural simplicity, ease of manufacturing, and low costs, ease of implementation and use to promote and increase the scope of applications, and is capable of outputting a broad beam, a collimated beam, or a beam in between the broad beam and the collimated beam.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A variable focus spotlight with spin type focusing structure, comprising:

a shell having a light exiting opening, at least two spiral slits and a light source holder, wherein the light exiting opening is disposed at one end of the shell, the at least two spiral slits are spiral slots penetrating through the shell body, and at least one light source is fixedly provided on the light source holder and disposed at the other end opposite to the light exit opening; a driving ring, fixedly provided surrounding a part of the shell; and a focusing module, coaxially provided beside the light source holder inside the shell, wherein the focusing module includes a lens being fixed on a lens holder and being illuminated by the light source, wherein at least two linking rods, each one penetrates through one of the at least two spiral slits and connects with the lens holder and the driving ring;

wherein the shell is one of a reflector and a reflector combined with a cup shape structure; wherein the light emergence surface of the lens is located in the reflector and the light exiting opening, so that the inner surface of the reflector is illuminated by the light emitted of the lens.

2. The variable focus spotlight with spin type focusing structure of claim 1, wherein the at least two spiral slits are 3 spiral slits and the at least two linking rods are 3 links rods.

3. The variable focus spotlight with spin type focusing structure of claim 1, wherein the light source holder is coaxially provided with the light exiting opening.

4. The variable focus spotlight with spin type focusing structure of claim 1, wherein the lens is coaxially provided with the light exiting opening.

5. The variable focus spotlight with spin type focusing structure of claim 1, wherein the driving ring rotates and drives the focusing module to pull near or away from the light source by the linking rods.

* * * * *